US005652077A

United States Patent [19]

Obinata

[11] Patent Number: 5,652,077

[45] Date of Patent: Jul. 29, 1997

[54] ELECTROPHOTOGRAPHIC IMAGE DRUM

[75] Inventor: Takashi Obinata, Nagano, Japan

[73] Assignee: Fuji Electric Co., Ltd., Kawasaki, Japan

[21] Appl. No.: 573,229

[22] Filed: Dec. 15, 1995

[30] Foreign Application Priority Data

Dec. 15, 1994 [JP] Japan ..... 6-311439

[51] Int. Cl.[6] ..... G03G 15/00

[52] U.S. Cl. ..... 430/56; 430/69; 399/159; 399/167

[58] Field of Search ..... 430/56, 69; 399/159, 399/167

[56] References Cited

FOREIGN PATENT DOCUMENTS 617026 5/1990 Japan .
5303228 12/1992 Japan .
540355 2/1993 Japan .

*Primary Examiner*—Mark Chapman
*Attorney, Agent, or Firm*—Morrison Law Firm

[57] ABSTRACT

An image drum, of electrically conductive resin, includes a cylinder element adhesively bonded, using a non-solvent adhesive, to a bearing/drive element. To insure secure attachment of the bearing/drive element to the cylinder element, the adhesively bonded surface of the cylinder resin element is activated, by ultraviolet light in the wavelength range of 180 to 255 nm or by corona discharge, prior to bonding. The volume resistivity of the cylinder element 1 is $10^4$ Ω-cm. The most suitable resins that can be used for cylinder element 1 include thermoplastic resins including polyethylene, polypropylene, polystyrene, and polyphenylene sulfide, and thermosetting resins including phenol, melamine, epoxy, and unsaturated polyester. Both groups should be made conductive in the range of $10^4$ Ω-cm, or less, resistivity. The required conductivity can achieved by adding carbon black to the chosen material of which cylinder element 1 is made.

46 Claims, 1 Drawing Sheet

ELECTROPHOTOGRAPHIC IMAGE DRUM

BACKGROUND OF THE INVENTION

The present invention relates to electrophotographic copying and image-producing machines and specifically to light-sensitive image transfer drums (hereinafter, "image drums"), used in such machines. More specifically, the invention relates to image drums made of conductive resin and having electrophotographic photoreceptive surfaces.

Image drums made of injection molded conductive resins are known. Also known is the fact that such image drums can be made by adhesively assembling a bearing/drive element of conductive resin to a cylindrical element. Typically, the cylinder element has an open end. A portion of the bearing element is shaped to fit into the cylinder element. Adhesives are used to secure the bearing element to the inside surface of the opening at the end of the cylinder element. The bearing element supports one end of the cylinder element and may incorporate a final drive element to transmit torque from a mechanical drive to the cylinder element to rotate it. The adhesive bond must transmit such torque.

In electrophotographic devices, such as copying machines or laser printers (hereinafter, "main device"), the image drum used to form the copy or print image, is supported in the main device on a cylindrical center shaft, to permit the drum to rotate. The surface of the image drum includes a photosensitive layer on the cylinder element. The material from which the cylinder element is made must conduct any charge accumulated on the surface.

To form an image, the drum is continuously rotated around the cylindrical shaft near a stationary charging element, or elements, to charge the surface. Selected portions of the charged surface are discharged by scanning a light image across the surface. This process creates an electrostatic latent image. The latent image is developed by applying toner to the surface and removing toner that does not adhere to the charged portion of the surface, resulting in a toner image. The toner image is then transferred to some other surface, such as paper, and fixed, usually by heat. During transfer, the image drum makes contact with the surface to which the toner is transferred, generating a frictional load on the drum which must be born by the attachment between the cylinder element and the bearing element. After the transfer of the toner image, toner remaining on the surface of the image drum is cleaned off, often by holding a cleaning element to the surface, again, generating a load that is born by the main device drive.

The image drum is assembled by inserting a portion of the bearing element into the open end of the cylinder element. To allow the cylinder element to be driven by the bearing element, the bearing element may include, for example, a geared flange or other final drive element. The portion of the bearing element fitted into the open end of the cylinder must be affixed to the interior surface of the cylinder to transmit torque applied to the bearing element. In addition, to discharge the portion of the charged surface, the cylinder element must be grounded. It is convenient to ground the cylinder through the bearing element. When the cylinder element is grounded through the bearing element, the attachment between the cylinder and bearing element must permit charge to flow from the cylinder element to the bearing element.

To obtain high quality images, the image drum must rotate smoothly, with uniform speed and without deflection, around the shaft. During the image formation and fixation processes described above, drag on the surface of the image drum is generated by image transfer and cleaning elements which make contact with the surface of the image drum generating a load. This load can be significant and variable, making it important to have a secure drive connection between the bearing element and the cylinder element of the image drum.

With recent reductions in the size and weight of electrophotographic devices, image drums are typically made of organic resin. The bearing element usually consists of a resin flange, that is secured to the resin cylinder with an adhesive. Solvent adhesives are generally used. The cylinder element of the image drum generally consists of a molded body of conductive resin. Compared to conventional drums of metal, such as aluminum alloy, conductive resin drums are lighter in weight and can be manufactured easily by molding. In addition, due to its smooth surface, the molded cylinder element does not require surface polishing as metal elements do. Thus, manufacturing costs of molded resin cylinder elements are lower than for metal cylinder elements. Furthermore, the surfaces of molded cylinder elements are resistant to corrosion and remain stable for long periods of time, even under hot and humid conditions.

Although solvent adhesives are generally used to connect the cylinder element to the flange of the bearing element, the adhesive drying process can consume much time. In addition, adhesive may scatter and stick to the surface of the image drum, or solvent vapors from the adhesive may adversely affect the photosensitive surface of the image drum, particularly its sensitivity. In addition, such adhesives perform poorly in combination with some types of resin used for the flange. Surface preparation may ameliorate adhesion with certain materials, however, such surface preparation may be insufficient. For example, polyacetal resin is currently preferred because it can be molded easily into complex shapes. Since, however, polyacetal resin performs poorly with most types of solvent adhesives, adjacent surfaces of the flange and cylinder are machined to create ridges which increase the adhesive area, thereby improving adhesion. Sufficient fixing strength, however, has still not been attained with this method.

With conductive resins, similar problems occur because conventional fixing methods, employing adhesives, provide inadequate strength. For example, a highly chemical-resistant material such as polyphenylene sulfide (PPS) performs poorly even when fine ridges are machined into the adjacent surfaces of the bearing and cylinder elements to increase the adhesive area.

OBJECTS AND SUMMARY OF THE INVENTION

An object of the present invention is to provide an image drum for electrophotographic processes that overcomes the drawbacks of the prior art.

Another object of the present invention is to provide a process for making an image drum that overcomes the drawbacks of the prior art.

Still another object of the present invention is to provide an image drum, with a bearing member securely connected thereto.

Still another object of the present invention is to provide a method of securely fastening a bearing/drive element to a cylinder element to form an image drum of an electrophotographic device.

Still another object of the present invention is to provide an image drum including cylinder and bearing elements of organic materials that are securely adhesively interconnected to form an image drum for an electrophotographic device.

Still another object of the present invention is to provide an image drum including cylinder and bearing elements of electrically conductive organic materials that are securely adhesively interconnected to form an image drum for an electrophotographic device.

Still another object of the present invention is to provide an image drum of organic material that is resistant to degradation by adhesives, which insures smooth and uniform rate of rotation, operates without abnormal sounds and produces defect-free images.

Still another object of the present invention is to provide an image drum in which a bearing element, of conductive resin, is attached within an open end of a cylinder element, of conductive resin, by a simple reliable process that creates a secure adhesive bond.

Briefly stated, the present invention provides an image drum, of electrically conductive resin, including a cylinder element adhesively bonded, using a non-solvent adhesive, to a bearing/drive element. To insure secure attachment of the bearing/drive element to the cylinder element, the adhesively bonded surface of the cylinder resin element is activated, by ultraviolet light in the wavelength range of 180 to 255 nm or by corona discharge, prior to bonding. The volume resistivity of the cylinder element 1 is no higher than $10^4$ Ω-cm. The most suitable resins that can be used for cylinder element 1 include thermoplastic resins including polyethylene, polypropylene, polystyrene, and polyphenylene sulfide, and thermosetting resins including phenol, melamine, epoxy, and unsaturated polyester. Both groups should be made conductive in the range of $10^4$ Ω-cm, or less, resistivity. The required conductivity can achieved by adding carbon black to the chosen material of which cylinder element 1 is made.

According to an embodiment of the present invention, there is provided, an electrophotographic image drum, comprising: a cylindrical element, of conductive resin, having an outwardly-facing surface, the cylindrical element having an end, the cylindrical element having an annular surface at the end, the outwardly-facing surface having a photosensitive layer thereon, a transmission element shaped to fit closely adjacent the annular surface, the annular surface being chemically treated to generate —OH and —COOH groups on the surface, the transmission element being secured to the annular surface by a non-solvent adhesive.

According to another embodiment of the present invention, there is provided, a method of forming an image drum, comprising: injection molding a conductive polymer to form a base of a cylinder element, forming a charge-generation layer on an outside surface of the base, forming a charge-transport layer on the charge-generation layer, chemically treating a surface of the cylinder element to generate —OH and —COOH groups, whereby a wettability of the surface is improved and securing the surface to a transmission element using a non-solvent adhesive.

According to still another embodiment of the present invention, there is provided, a method of forming an image drum, comprising: adding carbon black to a cross-linking type polyphenylene sulfide resin (cross-linkable polyphenylene sulfide resin) to form a mixture, injection molding the mixture into a cylindrical mold to form a base of a cylinder element, adding alcohol-soluble polyamide resin to methanol to form a coating material, coating an outer surface of the base to form a coated base, drying the coated base, forming a charge-generation layer on the coated base, forming a charge-transport layer on the charge-generation layer; generating ozone, chemically treating a surface of the cylinder element to generate —OH and —COOH groups, whereby a wettability of the surface is improved and securing the surface to a transmission element using a non-solvent adhesive.

According to still another embodiment of the present invention, there is provided, an electrophotographic image drum, comprising: a cylindrical element, of conductive resin, having an outwardly-facing surface, the cylinder element having a volume resistivity of not higher than about $10^4$ Ω-cm, the outwardly-facing surface having a photosensitive layer thereon, the cylindrical element having a transmission surface, a transmission element shaped to fit closely adjacent the transmission surface, the transmission surface being chemically treated to generate —OH and —COOH groups on the transmission surface and the transmission element being secured to the transmission surface by a non-solvent adhesive. The volume resistivity of the cylinder element 1 is $10^4$ Ω-cm. The most suitable resins that can be used for cylinder element 1 include thermoplastic resins including polyethylene, polypropylene, polystyrene, and polyphenylene sulfide, and thermosetting resins including phenol, melamine, epoxy, and unsaturated polyester. Both groups should be made conductive in the range of $10^4$ Ω-cm, or less, resistivity. The required conductivity can achieved by adding carbon black to the chosen material of which cylinder element 1 is made.

According to still another embodiment of the present invention, there is provided, an electrophotographic image drum, comprising: a cylinder of injection-molded conductive polymer having a first surface, a transmission element of polycarbonate having a second surface, the first surface being chemically altered by exposure to one of ultraviolet light and a corona discharge prior to a boding of the first surface to the second surface and the first and second surfaces being adhesively bonded with a non-solvent adhesive.

According to still another embodiment of the present invention, there is provided, an electrophotographic image drum, comprising: a cylindrical element, of conductive resin, having an outwardly-facing surface, the cylindrical element having an annular surface, the outwardly-facing surface having a photosensitive layer thereon and a transmission element shaped to fit closely adjacent the annular surface, the annular surface being chemically treated to generate —OH and —COOH groups on the surface, the transmission element being secured to the annular surface by a non-solvent adhesive, the cylinder element being of a material from the group consisting of polyethylene, polypropylene, polystyrene, and polyphenylene sulfide, and thermosetting resins including phenol, melamine, epoxy, and unsaturated polyester.

According to still another embodiment of the present invention, there is provided, an electrophotographic image drum, comprising: a cylindrical element, of conductive resin, having an outwardly-facing surface, the cylinder element being of thermoplastic resin with carbon black added to achieve a volume resistivity not higher than approximately $10^4$ Ω-cm, the outwardly-facing surface having a photosensitive layer thereon, the cylindrical element having a transmission surface, a transmission element shaped to fit closely adjacent the transmission surface, the transmission surface being chemically treated to generate —OH and —COOH groups on the transmission surface, the transmission element being secured to the transmission surface by a non-solvent adhesive, the cylindrical element having an opening at an end thereof, the transmission surface being an interior surface adjacent the opening and the transmission element being shaped to fit closely within the opening.

According to still another embodiment of the present invention, there is provided, an electrophotographic image drum, comprising: a cylinder of injection-molded conductive polymer having a first surface, a transmission element of polycarbonate having a second surface, the first surface being chemically altered by exposure to one of ultraviolet light and a corona discharge prior to a boding of the first surface to the second surface, the first and second surfaces being adhesively bonded with a non-solvent adhesive, the cylinder being of thermoplastic resin including carbon black and at least one material from a group consisting essentially of polyethylene, polypropylene, polystyrene, and polyphenylene sulfide, and thermosetting resins including phenol, melamine, epoxy, and unsaturated polyester.

According to still another embodiment of the present invention, there is provided, an electrophotographic image drum, comprising: a conductive resin cylinder having an opening end on at least one side, the opening having an inner circumferential face, a photosensitive layer formed on the outer circumferential face and a transmission element fitted in the opening and against the inner circumferential face, the transmission element being adapted to transmit an external motive force to the resin cylinder, the inner circumferential face being activated by ultraviolet radiation, the transmission element being secured to the resin cylinder with a non-solvent adhesive.

According to still another embodiment of the present invention, there is provided, an electrophotographic image drum, comprising: a conductive resin cylinder having an opening end on at least one side, the opening having an inner circumferential face, a photosensitive layer formed on the outer circumferential face and a transmission element fitted in the opening and against the inner circumferential face, the transmission element being adapted to transmit an external motive force to the resin cylinder, the inner circumferential face being activated by a corona discharge, the transmission element being secured to the resin cylinder with a non-solvent adhesive.

The above, and other objects, features and advantages of the present invention will become apparent from the following description read in conjunction with the accompanying drawings, in which like reference numerals designate the same elements.

DETAILED DESCRIPTION OF THE PREFERRED EMBODIMENT

Figure 1:
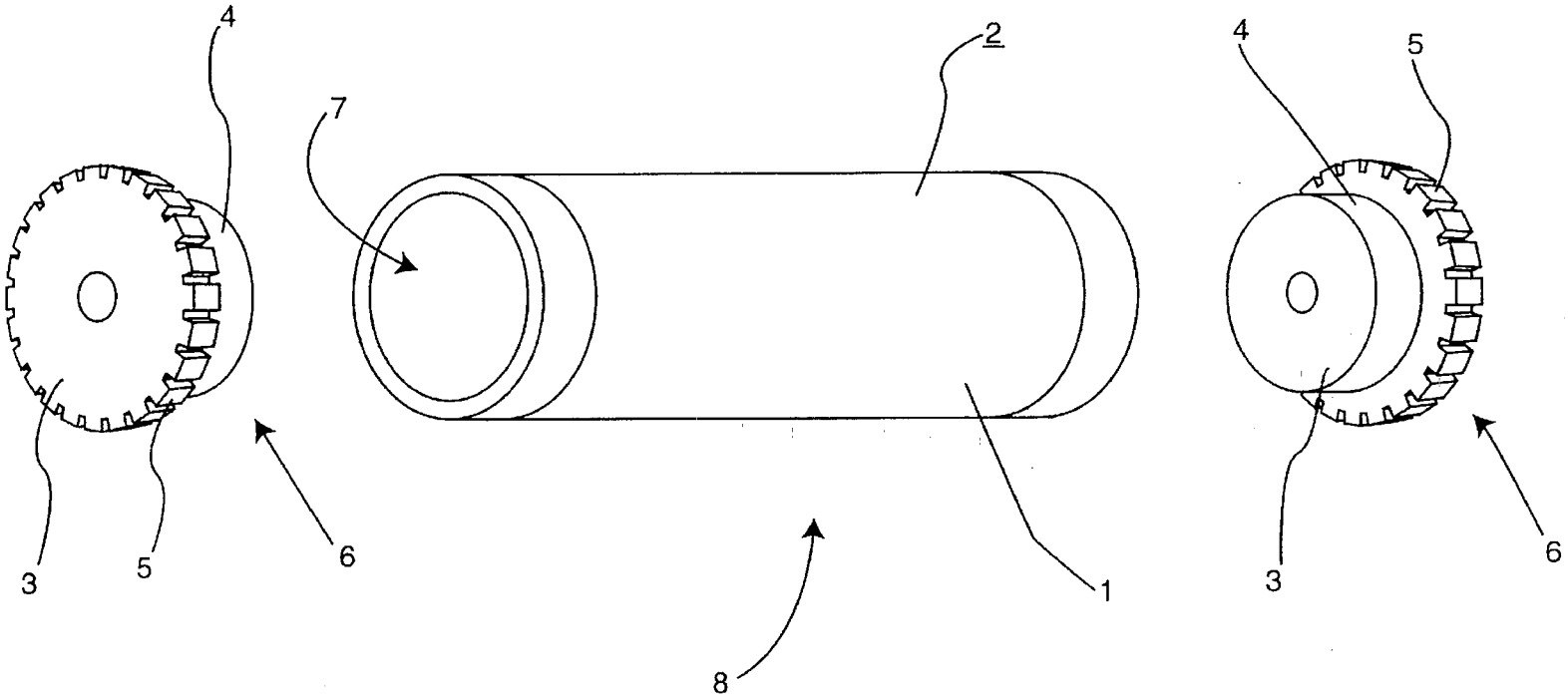
FIG. 1 is an exploded perspective view of the elements of an image drum according to an embodiment of the invention.

Referring to FIG. 1, an image drum 8 for an electrophotographic device includes a cylinder element 1 of electrically conductive resin, with a photosensitive surface 2 on its outwardly facing surface. A bearing element 6 includes a flange portion 3, with a stage 4, that fits into an opening 7 at an end of cylinder member 1. An outer diameter of stage 4 is close enough to the inner diameter of cylinder element 1 to insure a close fit. Flange 3 is attached to cylinder element 1 by applying an adhesive to stage 4 and fitting flange 3 into opening 7 at the end of cylinder element 1.

Gear teeth encircle an end of bearing element 6 opposite flange 3 to form a gear 5. Gear 5 is driven by a drive (not shown) to rotate image drum 8. Thus, torsional forces are transmitted through the adhesive bond between bearing element 6 and cylinder element 1 when gear 5 is driven to rotate image drum 8.

Photosensitive surface 2 is formed by sequentially laminating charge generation and transport layers on the surface of cylinder member 1. An undercoating layer may be provided between the cylinder element 1 and the photosensitive surface 2 as required.

Embodiment 1

To form image drum 8 with photosensitive surface 2, according to a first embodiment of the invention, the following steps were followed. Twenty-five percent (by weight) of carbon black and 15 percent (by weight) of glass fibers were added to a cross-linking type polyphenylene sulfide resin (cross-linkable polyphenylene sulfide resin). The mixture was kneaded and injection-molded into a cylindrical mold having an outer diameter of 30 mm, an inner diameter of 28 mm, and a length of 250 mm to form the base of cylinder element 1. Five percent (by weight) of alcohol-soluble polyamide resin (Amilan CM8000 manufactured by Torey Co., Ltd.) was added to 95% (by weight) methanol. The mixture was heated and dissolved at 50 C. The solution was then used to coat the outer surface of the base of cylinder element 1. The coated base was then dried at 100 C. for 15 minutes, forming an under-coating layer measuring 1 μm in thickness.

One percent (by weight) of X-type non-metal phthalocyanine (FAST GEN BLUE 8120 manufactured by Dainihon Ink Chemical Industry Co., Ltd.), 1% (by weight) of polyvinyl butyral (S-LEC BM1 manufactured by Sekisui Chemical Industry Co., Ltd.), and 98% (by weight) of dichloromethane were mixed and dispersed for one hour using a sand mill apparatus. The dispersant was coated on the under-coating layer. The base was then dried at 80 C. for 30 minutes to form a charge-generation layer 0.5 μm in thickness.

A solution consisting of 10% (by weight) of hydrazone compound described by Formula 1 (manufactured by Fuji Electric Co., Ltd.), 10% (by weight) of polycarbonate resin (Iupilon PCZ manufactured by Mitsubishi Gas Chemical Co., Ltd.), and 80% dichloromethane was coated on the charge-generation layer. The cylinder element was then dried at 100 C. for one hour to form a charge-transport layer which measured 20 μm in thickness, to form photosensitive surface 2.

Formula 1

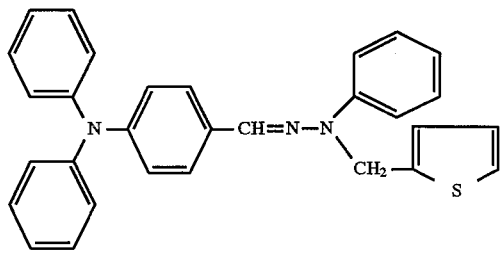

Opening 7 at the end of cylinder element 1, according to the first embodiment of the invention, was produced in the above manner. The interior surface area intended to be adjacent stage 4 of flange 3, near opening 7, was irradiated with ultraviolet light spanning a range of wavelengths between 180 and 255 nm using a 200 W low-pressure mercury lamp source (SUV200NS manufactured by Sen Engineering Co., Ltd.). The surface was irradiated for 20 seconds at a distance of 10 mm between the surface of the mercury lamp and the surface of cylinder element. Intensity values vary between lamps from different manufacturers. The intensity supplied by the SUV200NS is in the range of 10 and 50 mW/cm$^2$ for the conditions specified above. The temperature of the environment of a mercury vapor lamp affects its output. For the tests performed, the ambient temperature was maintained at 23+/−1 C. (50+/−10% RH).

Bearing element 6 with flange 5 of polycarbonate was subsequently secured to the end of cylinder element 1 using a non-solvent alphacyanoacrylate adhesive (Alon Alfa manufactured by Toa Synthetic Chemical Industry Co., Ltd.). The image drum was then mounted on a commercially-available semiconductor laser printer to permit continuous-image printing tests. Even after image printing on more than 10,000 sheets of A4 paper, there were no problems caused by poor adhesion between cylinder element 1 and flange 5. No loosening of flange 5 from cylinder element 1, abnormal sounds, or degraded image quality were observed. It was concluded that the adhesive strength of the bond between bearing member 3 and cylinder element 1 of image drum 8, made by the process described above, was sufficient to perform reliably in a laser printer.

Comparative Example 1

A test version of Image drum 8 was produced as in Embodiment 1, except that the bonded surfaces were not treated with ultraviolet light irradiation prior to securing cylinder element 1 to bearing element 1 with adhesive. The same continuous-image printing tests were conducted on image drum 8 assembled according to Embodiment 1. The results of the tests of Comparative Example 1 were: after printing on 200 sheets of A4 paper, a gap was observed between cylinder element 1 and bearing element 3, indicating poor adhesion. As a result, noise, non-uniform images, and inadequate electrical grounding of cylinder element 1 were observed.

Comparative Example 2

A second test version of image drum 8 was made exactly as comparative example 1, except that a synthetic rubber solvent adhesive (High Contact manufactured by Cemedine Co., Ltd) containing ethyl acetate and n-hexane was used instead of the non-solvent adhesive. That is, no pretreatment with ultraviolet light was performed. Continuous image printing tests were conducted on this image drum 8 as performed on Embodiment 1. After image printing on 500 sheets of A4 paper, image drum 8 began to stall, producing non-uniform printed images.

An additional test was performed on the second test version of image drum 8, made according to Comparative Example 2. Fifty image drums 8, made according to Comparative Example 2, were stored in a constant-temperature sealed container for two months exposing photosensitive surfaces 2 of image drums 8 to solvent vapors. When image drums 8 were later removed from the container and subjected to image printing tests with a commercially-available semiconductor laser beam printer, the images obtained were blurry. It is believed the blurry images were caused by solvent in the adhesive.

Embodiment 2

Another embodiment of the invention was made as Embodiment 1, except that instead of pretreating with ultraviolet light, a corona discharge was used. Before securing bearing element 6 to cylinder element 1, the surfaces to be bonded were exposed to a corona discharge for 30 seconds. A 5 kV discharge electrode was held a distance of 10 mm from the surface. The measured current was 80 μA. The discharge electrode used was corotron, a material widely used in electrophotographic machines.

Bearing element 6 was adhesively bonded to cylinder element 1 and the resulting embodiment of image drum 8 tested according to the same procedure used for testing Embodiment 1. When continuous image printing tests were conducted on this image drum 8, as for Embodiment 1, the observed results were the same as those seen for Embodiment 1.

The bonding surface of cylinder element 1 at opening 7, where bearing element 6 attaches, is irradiated with ultraviolet rays or subjected to a corona discharge process before adhesively attaching bearing element 6 to cylinder element 1. The pretreatment produces a result that is adequate for making a durable image drum 8—stalling and slipping are prevented over a long operating period. Fixing strength between cylinder element 1 and bearing element 6 is observed to be significantly higher than for prior art methods of attachment. Inconveniences due to bad fixation, such has idle running, abnormal sounds, and defective images are prevented.

The use of a non-solvent adhesive to attach cylinder element 1 to bearing element 6 permits easy assembly and avoids contamination and/or degradation of photosensitive surface 2 of image drum 8 by adhesive and/or solvent vapors.

Particularly high bond strength has been observed using resin made by adding an appropriate amount of carbon black to a cross-linkable polyphenylene sulfide as the conductive resin for cylinder element 1. Image drum 8 must have high dimensional precision, as well as high bonding strength between cylinder element 1 and bearing element 6. For this reason, for injection-molding a cylinder element 1 with precise dimensions, 20% or less (by weight) of carbon black should be added to the resin. In addition, the carbon black must have a high conductivity, with a volume resistivity of $10^{-1}$ Ω-cm, or less. The carbon black should have an average particle size of 20 to 50 nm. A dispersant such as calcium carbonate or clay can be simultaneously added to the resin to uniformly disperse the carbon black. A reinforcement material such as glass fibers may be added to the conductive resin in order to improve the mechanical strength of image drum 8.

The non-solvent adhesive used for attaching cylinder element 1 to bearing element 6 should be a mixture of a viscous resin (liquid at normal temperatures) and a hardener. Two such adhesives are cyano-acrylate and epoxy. The cyano-acrylate adhesive includes "Alon Alfa" made by Toa Gosei Kagaku Kogyo Co., Ltd., and "Eastman 910" made by Eastman Kodak Co., Ltd. The hardener for such adhesives is moisture in the air. The epoxy adhesive includes "Epicoat 815", "Epicoat 827", and "Epicoat 834", all made by Shell Kagaku Co., Ltd., and "Araldite GY252" and "Araldite GY250" made by Ciba-Geigy Co., Ltd. The hardeners used for such adhesives are amino hardeners such as triethylene tetramine and diaminodiphenylmethane. The hardener should account for 5–35 percentage by weight of the adhesive.

Exposing the open end of cylinder element 1, that will contact bearing element 6, to ultraviolet light generates ozone from oxygen in the air. The energy of the ultraviolet light cuts molecular chains on the top surface of the resin, and moisture in the resin acts to generate —OH and —COOH groups on the surface, thereby substantially improving the wettability of the surface without degrading the required functions of the image drum. The ultraviolet light used should have wavelengths from 180 to 255 nm. In corona discharge processing, the energy of corona discharge generates ozone and results in similar effects.

In addition, resins made by adding carbon black to cross-linking type polyphenylene sulfide resin (cross-linkable polyphenylene sulfide resin) may be used for cylinder element 1 drum. Because of the moldability of this resin, image drum 8 can have precise dimensions to enable a precise fit between bearing element 6 and cylinder element 1. The precise fit improves the bonding strength. High thermal and chemical resistance of the resin should also serve to maintain dimensional precision, thereby preventing the fixing strength from decreasing.

Although in Embodiment 2, the where a corona discharge was used to pretreat the surface of cylinder element 1, in an alternative embodiment, the surface had been treated with 10 kV at an electrode distance of 2–3 mm. While Embodiment 2 where a 5 kV discharge electrode was held a distance of 10 mm from the surface was found to be superior, the alternative embodiment employing a 10 kV electrode at a distance of 2–3 mm also produces adequate results.

Having described preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. An electrophotographic image drum, comprising:

a cylindrical element, of conductive resin, having an outwardly-facing surface;

said cylindrical element having an end;

said cylindrical element having an annular surface at said end;

said outwardly-facing surface having a photosensitive layer thereon; and a transmission element shaped to fit closely adjacent said annular surface;

said annular surface being chemically treated to generate —OH and COOH groups on said surface;

said transmission element being secured to said annular surface by a non-solvent adhesive.

2. An image drum as in claim 1, wherein said transmission element is of poly carbonate.

3. An image drum as in claim 1, wherein said annular surface is chemically treated by exposure to ultraviolet radiation.

4. An image drum as in claim 3, wherein said ultraviolet radiation is characterized by wavelengths ranging from 180 to 255 nm.

5. An image drum as claim 3, wherein said transmission element includes means for being rotated by an external motive force, said motive force causing said transmission element to rotate.

6. An image drum as in claim 5, wherein said motive force is transmitted as a torque through an interface formed by said non-solvent adhesive.

7. An image drum as in claim 1, wherein said annular surface is chemically treated by exposure to a corona discharge.

8. An image drum as claim 7, wherein said transmission element includes means for being rotated by an external motive force, said motive force causing said transmission element to rotate.

9. An image drum as in claim 8, wherein said motive force is transmitted as a torque through an interface formed by said non-solvent adhesive.

10. An image drum as in claim 1, wherein:

said cylindrical element has an opening at said end;

said annular surface is an interior surface adjacent said opening; and said transmission element is shaped to fit closely within said opening.

11. An image drum as in claim 10, wherein said cylinder element is of thermoplastic resin.

12. A method of forming an image drum, comprising:

injection molding a conductive polymer to form a base of a cylinder element;

forming a charge-generation layer on an outside surface of said base;

forming a charge-transport layer on said charge-generation layer;

chemically treating a surface of said cylinder element to generate —OH and —COOH groups, whereby a wettability of said surface is improved; and securing said surface to a transmission element using a non-solvent adhesive.

13. A method as in claim 12, wherein said step of chemically treating includes exposing said surface to ultraviolet light.

14. A method as in claim 13, wherein said ultraviolet radiation is characterized by wavelengths ranging from 180 to 255 nm.

15. A method as in claim 14, wherein said exposing includes irradiating said surface at an intensity in the range of 10 and 50 $mW/cm^2$.

16. A method as in claim 12, wherein said step of chemically treating includes exposing said surface to a corona discharge.

17. A method of forming an image drum, comprising:

adding carbon black to a cross-linkable polyphenylene sulfide resin to form a mixture;

injection molding said mixture into a cylindrical mold to form a base of a cylinder element;

adding alcohol-soluble polyamide resin to methanol to form a coating material;

coating an outer surface of said base to form a coated base;

drying said coated base;

forming a charge-generation layer on said coated base;

forming a charge-transport layer on said charge-generation layer generating ozone;

chemically treating a surface of said cylinder element to generate —OH and —COOH groups, whereby a wettability of said surface is improved; and securing said surface to a transmission element using a non-solvent adhesive.

18. A method as in claim 17, wherein said step of securing includes applying alphacyanoacrylate adhesive to said surface.

19. An electrophotographic image drum, comprising:

a cylindrical element, of conductive resin, having an outwardly-facing surface;

said cylinder element having a volume resistivity not higher than approximately $10^4$ Ω-cm;

said outwardly-facing surface having a photosensitive layer thereon;

said cylindrical element having a transmission surface;

a transmission element shaped to fit closely adjacent said transmission surface;

said transmission surface being chemically treated to generate —OH and —COOH groups on said transmission surface; and said transmission element being secured to said transmission surface by a non-solvent adhesive.

20. An image drum as in claim 19, wherein said transmission element is of poly carbonate.

21. An image drum as in claim 19, wherein said transmission surface is chemically treated by exposure to ultraviolet radiation.

22. An image drum as in claim 21, wherein said ultraviolet radiation is characterized by wavelengths ranging from 180 to 255 nm.

23. An image drum as claim 21, wherein said transmission element includes means for being rotated by an external motive force, said motive force causing said transmission element to rotate.

24. An image drum as in claim 23, wherein said motive force is transmitted as a torque through an interface formed by said non-solvent adhesive.

25. An image drum as in claim 19, wherein said transmission surface is chemically treated by exposure to a corona discharge.

26. An image drum as claim 25, wherein said transmission element includes means for being rotated by an external motive force, said motive force causing said transmission element to rotate.

27. An image drum as in claim 26, wherein said motive force is transmitted as a torque through an interface formed by said non-solvent adhesive.

28. An image drum as in claim 19, wherein:

said cylindrical element has an opening at an end thereof;

said transmission surface is an interior surface adjacent said opening; and said transmission element is shaped to fit closely within said opening.

29. An image drum as in claim 28, wherein said cylinder element is of thermoplastic resin.

30. An electrophotographic image drum, comprising:

a cylinder of injection-molded conductive polymer having a first surface;

a transmission element of polycarbonate having a second surface;

said first surface being chemically altered by exposure to one of ultraviolet light and a corona discharge prior to bonding of said first surface to said second surface; and said first and second surfaces being adhesively bonded with a non-solvent adhesive.

31. An image drum as claim 30, wherein said transmission element includes means for being rotated by an external motive force, said motive force causing said transmission element to rotate.

32. An image drum as in claim 31, wherein said motive force is transmitted as a torque through an interface formed by said non-solvent adhesive.

33. An image drum as in claim 30, wherein:

said cylinder has an opening at an end thereof;

said second surface is an interior surface adjacent said opening; and said transmission element is shaped to fit closely within said opening.

34. An image drum as in claim 30, wherein said cylinder is of thermoplastic resin.

35. An electrophotographic image drum, comprising:

a cylindrical element, of conductive resin, having an outwardly-facing surface;

said cylindrical element having an annular surface;

said outwardly-facing surface having a photosensitive layer thereon; and a transmission element shaped to fit closely adjacent said annular surface;

said annular surface being chemically treated to generate —OH and —COOH groups on said surface;

said transmission element being secured to said annular surface by a non-solvent adhesive;

said cylinder element being of a material from the group consisting of polyethylene, polypropylene, polystyrene, and polyphenylene sulfide, and thermosetting resins including phenol, melamine, epoxy, and unsaturated polyester.

36. An image drum as in claim 35, wherein said cylinder element has a resistivity of approximately $10^4$ Ω-cm, or less.

37. An image drum as in claim 35 wherein said cylinder element contains carbon black.

38. An electrophotographic image drum, comprising:

a cylindrical element, of conductive resin, having an outwardly-facing surface;

said cylinder element being of thermoplastic resin with carbon black added to achieve a volume resistivity not higher than approximately $10^4$ Ω-cm;

said outwardly-facing surface having a photosensitive layer thereon;

said cylindrical element having a transmission surface;

a transmission element shaped to fit closely adjacent said transmission surface;

said transmission surface being chemically treated to generate —OH and —COOH groups on said transmission surface;

said transmission element being secured to said transmission surface by a non-solvent adhesive;

said cylindrical element having an opening at an end thereof;

said transmission surface being an interior surface adjacent said opening; and said transmission element being shaped to fit closely within said opening.

39. An image drum as in claim 38, wherein said thermoplastic resin is one of a group consisting essentially of polyethylene, polypropylene, polystyrene, and polyphenylene sulfide, and thermosetting resins including phenol, melamine, epoxy, and unsaturated polyester.

40. An electrophotographic image drum, comprising:

a cylinder of injection-molded conductive polymer having a first surface;

a transmission element of polycarbonate having a second surface;

said first surface being chemically altered by exposure to one of ultraviolet light and a corona discharge prior to a boding of said first surface to said second surface;

said first and second surfaces being adhesively bonded with a non-solvent adhesive;

said cylinder being of thermoplastic resin including carbon black and at least one material from a group consisting essentially of polyethylene, polypropylene, polystyrene, and polyphenylene sulfide, and thermosetting resins including phenol, melamine, epoxy, and unsaturated polyester.

41. An electrophotographic image drum, comprising:

a conductive resin cylinder having an opening end on at least one side;

said opening having an inner circumferential face;

a photosensitive layer formed on the outer circumferential face; and a transmission element fitted in said opening and against said inner circumferential face;

said transmission element being adapted to transmit an external motive force to said resin cylinder;

said inner circumferential face being activated by ultraviolet radiation; said transmission element being secured to said resin cylinder with a non-solvent adhesive.

42. An image drum as in claim 41, wherein said resin cylinder contains an amount of carbon black sufficient to insure a volume resistivity of not higher than approximately $10^4$ Ω-cm.

43. An image drum as in claim 42, wherein said resin is a cross-linking polyphenylene sulfide.

44. An electrophotographic image drum, comprising:

a conductive resin cylinder having an opening end on at least one side;

said opening having an inner circumferential face;

a photosensitive layer formed on the outer circumferential face; and a transmission element fitted in said opening and against said inner circumferential face;

said transmission element being adapted to transmit an external motive force to said resin cylinder;

said inner circumferential face being activated by a corona discharge;

said transmission element being secured to said resin cylinder with a non-solvent adhesive.

45. An image drum as in claim 44, wherein said resin cylinder contains an amount of carbon black sufficient to insure a volume resistivity of not higher than approximately $10^4$ Ω-cm.

46. An image drum as in claim 45, wherein said resin is a cross-linking polyphenylene sulfide.

* * * * *